US006260590B1

(12) United States Patent
Ziegmann

(10) Patent No.: US 6,260,590 B1
(45) Date of Patent: Jul. 17, 2001

(54) TRANSFER FUNNEL

(76) Inventor: Neil Ziegmann, 1010 270th St., Kiron, IA (US) 51448

( * ) Notice: Subject to any disclaimer, the term of this patent is extended or adjusted under 35 U.S.C. 154(b) by 0 days.

(21) Appl. No.: 09/454,962

(22) Filed: Dec. 6, 1999

(51) Int. Cl.[7] ..... B65B 1/04
(52) U.S. Cl. ..... 141/332; 141/364
(58) Field of Search ..... 141/331–345, 141/364, 299, 300, 363, 365, 366

(56) References Cited

U.S. PATENT DOCUMENTS 2,517,759 * 8/1950 Bentzen .
2,703,670 * 3/1955 Voight .
2,767,744 * 10/1956 Beerman .
3,211,195 * 10/1965 Porter .
5,269,354 * 12/1993 Koberg ..... 141/332
5,472,025 * 12/1995 Conrad et al. ..... 141/332
5,533,553 * 7/1996 Vesborg .
5,642,763 * 7/1997 Kurtz ..... 141/332

* cited by examiner

*Primary Examiner*—Steven O. Douglas
(74) *Attorney, Agent, or Firm*—Zarley, McKee, Thomte, Voorhees & Sease

(57) ABSTRACT

A funnel usable for transferring relatively viscous fluids from one container to another. The funnel includes either extending posts or threaded walls which are engageable with the container from which the fluid is to flow. The funnel may have a tubular section to fit into the neck of a receiving container of comparable size, such a section may give added stability to an upper part of the arrangement.

20 Claims, 2 Drawing Sheets

TRANSFER FUNNEL

BACKGROUND AND SUMMARY OF THE INVENTION

The invention pertains to funnels designed to allow easy transfer of flowing material—either fluid or particulate from one container to a second container and more specifically to a funnel for transfer normally of a liquid from a container which usually has a screw-threaded neck to another container.

Frugal kitchen workers and others often try to salvage small amounts of unused syrup, catsup and similar viscous liquid foods by transferring remnants from a used bottle to a newly purchased container simply by inverting the nearly empty container and waiting—sometimes for long periods—for the liquid to drain from that empty container into a nearly full container. Unfortunately, it is a fairly frequent occurrence to have the upper bottle slip off the lower container. The result may be drainage of some of the liquid onto the surface of the kitchen counter or the like—a rather unsatisfactory result.

Frugal mechanics may be in much the same position with liquids of relatively high viscosity and which are not used in full container quantities. Motor oils for small engines may be one example. Other oils for hydraulic equipment may be another.

It is obvious that some method of ensuring continuous drainage arrangement between the two containers is desirable. The device embodying the present invention is one possible expedient.

DESCRIPTION

Figure 1:
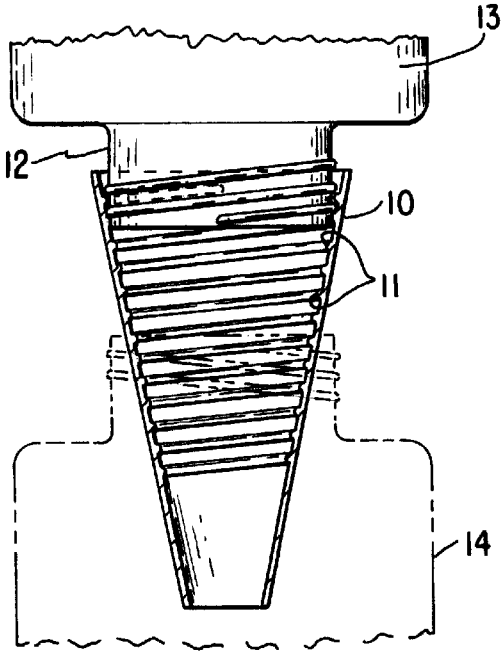
FIG. 1 is a side elevational view, partly in section of one alternative funnel in place between two containers.
Figure 3:
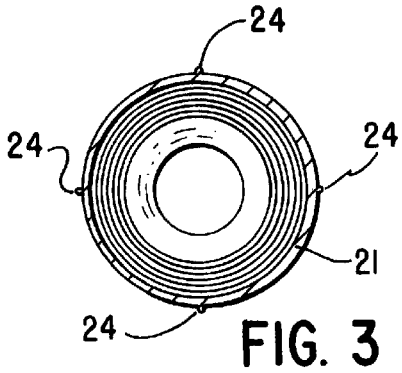
FIG. 3 is a sectional view from line 3—3 of FIG. 2 showing a preferred formation of the exterior of the alternative funnel.

Briefly this invention comprises a funnel which can be fastened to a container and used to guide material from that container into a second container.

More specifically and referring to the drawings, the funnel 10 of one simple alternative may be formed in a conical shape having a larger diameter at one end than the other. On the inner side of the cone, a series of screw threads 11 is formed. These threads have a pitch of approximately the spacing of threads on cans or bottles of the material to be transferred. Since these threads on the necks 12 of containers 13 are all approximately the same, that pitch may be uniform for a funnel. Cones may be designed for use with various sizes of containers or for a variety of materials. The pitch of the threads in the cone may be varied as the size of the cone varies.

The taper on the funnel should be such that the narrow end will fit nicely within the receiving container. To be certain of this, it is envisioned that the funnels may be sold in one package containing a plurality of sizes, but it should be noted that the transfer of the liquid will normally take place between similar sized containers so that if the funnel can be threaded the neck of the near-empty container, the narrow end will, in all likelihood, fit into the receiving container 14.

Figure 2:
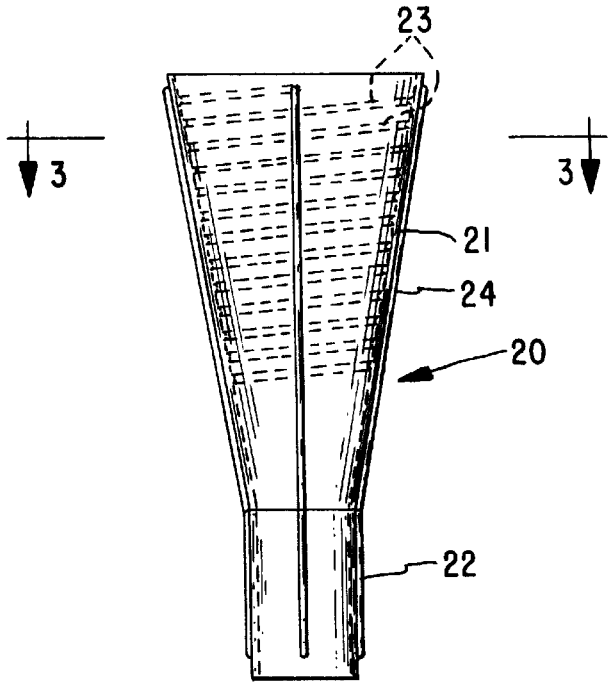
FIG. 2 is a view similar to FIG. 1 of another alternative embodiment of the invention.
Figure 6:
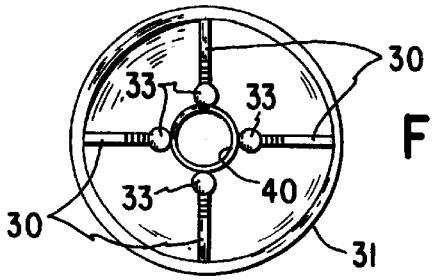
FIG. 6 is top plan view of the device of FIG. 4.
Figure 4:
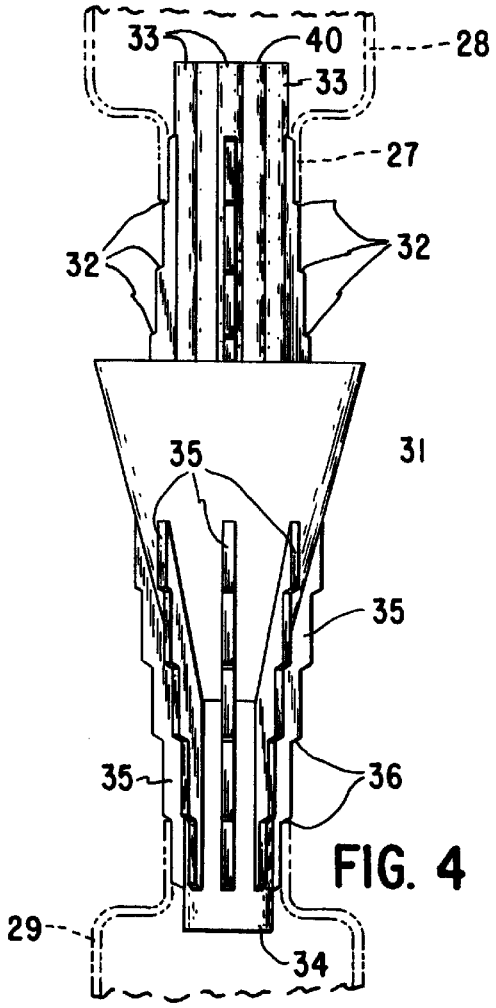
FIG. 4 is a side elevational view of the preferred embodiment of the invention.
Figure 5:
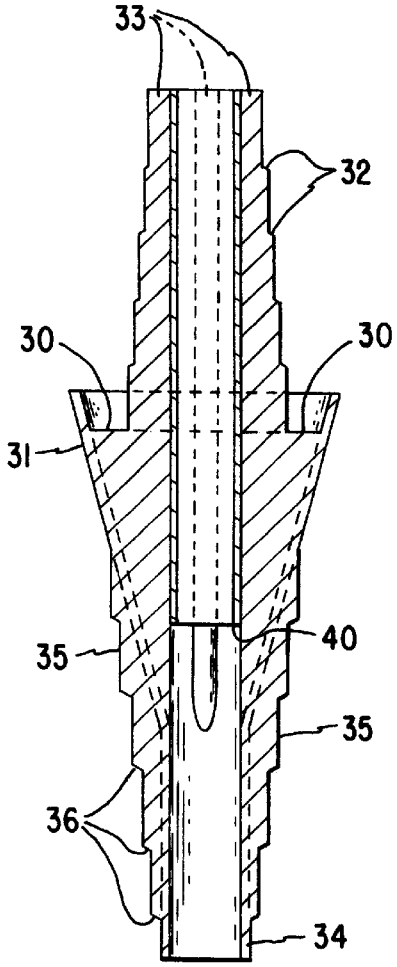
FIG. 5 is a medial sectional view of the device of FIG. 4.
Figure 7:
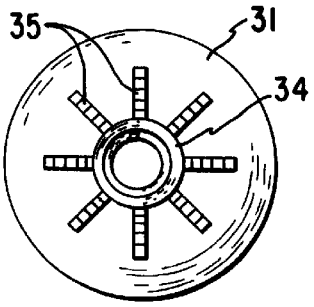
FIG. 7 is a bottom plan view of the device of FIG. 4.

A first modification of the funnel is shown in FIG. 2. In this embodiment which, though not the most preferred embodiment might be selected as better than the first, the funnel 20 is comprised of a conical section 21 very similar to the first described embodiment and a tubular section 22. The conical section is formed with threads 23 in the same manner as the original embodiment so that it can still be threaded onto the neck of a near empty container. However, the tubular section 22 may be of a size to fit into the neck of a receiving container. Where there is repetitive use with receiving containers of the same size, such a section may give added stability to the upper part of the arrangement.

In this embodiment the exterior of the funnel is formed with a series of ridges 24. The ridges, by allowing for the passage of air between the conical section 21 and the neck of the bottle into which the funnel is inserted, provide a much easier insertion and withdrawal of the device compared to the first described embodiment.

It will be apparent that with either of the first two embodiments, the invention provides a relatively stable assembly for the transfer of liquid from one container to another. To use the device, it is necessary only to thread the funnel onto the threads of the near empty contain 13. Because of the taper of the funnel, there will be only one or two threads engaged, but that is normally adequate to provide a reasonably tight fit. The container with the funnel attached may then be inverted so that the funnel will engage the interior of the receiving container 14. With the first embodiment, the taper of the funnel will fit relatively tightly into the neck of the receiving container so that the assembly may be set in place and left to drain. With the second embodiment, the tubular section 22, as it fits more snugly into the neck of the receiving container may provide an even more stable assembly to be left to drain. In either case, the assembly of the two containers joined by the funnel may be set on a workbench or kitchen counter to drain from one container to another while the user goes about his or her other activities.

The preferred embodiment is illustrated in FIGS. 4–7. In this device, the threads on the funnel interior are dispensed with. Instead a plurality of stepped posts 30 or vanes extend upwardly from the interior of a funnel 31. These posts are designed to extend into the neck 27 of a bottle 28, and have steps 32 to engage the neck of the bottle depending on the inner diameter of that neck. The device illustrated shows four of the posts 30. It will, however, be evident that three such posts could be used, or that more than four might be used as desired and dependent on the inner diameter of the bottle neck 27. Reinforcing ribs 33 (FIG. 6) may be used to strengthen and stiffen the posts 30. For added support a tube 40 extending from the top of the posts 30 partially into the funnel may be desirable.

Similarly on the exterior of the funnel 31 and extending down the delivery spout 34 are a series of placement ribs 35. These ribs 35 are also formed with steps 36 for better fitting the funnel spout 34 into the neck of the receiving bottle 29. Thus, with the steps 32 and 36 both the first container which is being drained and the receiving container can be stabilized and supported in the same manner as they are held by the threads in the first and second described embodiments.

What is claimed is:

1. A funnel device for transferring material from a first container, having a discharge opening to a second container, said device comprising a hollow shell having an inner surface and an outer surface, said inner surface being formed with a plurality of posts extending from the interior of said shell, said posts being adapted to extend into and engage the discharge opening of said first container to stabilize said first container in a position above said second container.

2. The funnel device of claim 1 in which a support structure is placed central of the posts and in rigid contact with the posts to support the posts.

3. The funnel device of claim 2 wherein the support structure is a tube.

4. The funnel device of claim 1 in which said posts are formed with steps to engage said discharge opening and to provide engagement with discharge openings of a variety of diameters.

5. The funnel device of claim 1 in which said second container includes an entrance opening, the exterior of said shell includes placement ribs, said ribs being adapted to extend into said entrance opening.

6. The funnel device of claim 5 in which said placement ribs are formed with steps, said steps being engageable with said entrance opening to hold said funnel device in position on said second container.

7. The funnel device of claim 5 in which said shell is cone shaped having a first end with a larger diameter and a second end with a smaller diameter, said posts extend upward from said first end.

8. The funnel device of claim 7 in which said shell includes a tubular extension from said second end.

9. The funnel device of claim 8 in which said placement ribs are formed on the exterior of said shell and said extension.

10. The funnel device of claim 1 in which said posts are formed with reinforcing ribs.

11. A device for transferring material from a first bottle to a second bottle, each bottle having a neck with an opening through which material is transferable, the device comprising:

a funnel separate from the first bottle and the second bottle, the funnel having an upper end adapted to engage and extend into the neck of the first bottle, and an opposite lower end adapted to extend into the neck of the second bottle such that the first bottle is supported over the second bottle with the openings being aligned such that material can flow from the first bottle through the funnel into the second bottle.

12. The device for transferring material from a first bottle to a second bottle of claim 11 in which said funnel also includes a tubular extension extending from said lower end.

13. The device for transferring material from a first bottle to a second bottle of claim 11 in which said funnel includes a tubular extension extending from said lower end of said funnel, said extension being insertable into said neck of said second bottle.

14. The device of claim 11 wherein the funnel includes an enlarged diameter portion between the upper and lower ends.

15. A funnel device for transferring material from a first container to a second container wherein the first container includes a discharge opening, said device comprising:

a hollow shell having an inner surface and an outer surface, said inner surface being formed with a plurality of posts extending from the inner surface and into said discharge opening of said first container to stabilize said first container in a position above said second container and wherein a tube is placed central of said posts to support said posts, said tube extending from the top of said posts into said shell.

16. Funnel device for transferring material from a first container, including a discharge opening, to a second container, said device comprising:

a hollow shell having an inner surface and an outer surface, said inner surface being formed with a plurality of posts extending from the inner surface of said shell, wherein said posts are formed with steps to engage said discharge opening and to provide engagement with discharge openings of a variety of diameters, and said posts extend into said discharge opening.

17. A funnel device for transferring material from a first container, including a discharge opening, to a second container, including an entrance opening, said device comprising:

a hollow shell having an inner surface and an outer surface and wherein said shell is cone shaped and having a first end with a larger diameter and a second end with a smaller diameter, said inner surface being formed with a plurality of posts extending from the inner surface of said shell upward from said first end, and wherein the outer surface of said shell includes placement ribs being adapted toe extend into the entrance opening and tubular extension from said second end.

18. The funnel device of claim 17 in which said placement ribs are formed on the exterior of said shell and said extension.

19. A funnel device for transferring material from a first container to a second container, wherein said first container and said second container both have necks for filling and for discharge of said material and said neck on said first container having external threads, said device comprising:

a hollow shell having an inner surface and an outer surface, said inner surface being formed with means for engaging the interior of said first container to stabilize said first container in a position above said second container, and wherein said shell is cone shaped having a first end with a larger diameter and a second end with a smaller diameter, said small diameter of said shell being insertable into said neck of said second container and said larger diameter of said shell being formed with internal screw threads engageable with said external threads on said neck of said first container; and ridges formed on the outer surface to space said shell from said neck of said second container.

20. A device for transferring material from a first bottle to a second bottle, each bottle having a neck with an opening through which material is transferable, the device comprising:

a funnel formed with ridges on the exterior to space the funnel from the neck of the second bottle, the funnel having an upper end adapted to engage and extend into the neck of the first bottle, and an opposite lower end adapted to extend into the neck of the second bottle such that the first bottle is supported over the second bottle with openings being aligned such that material can flow from the first bottle through the funnel into the second bottle.

* * * * *